United States Patent [19]

Röck et al.

[11] Patent Number: 4,641,394

[45] Date of Patent: Feb. 10, 1987

[54] SPRING-BIASED FURNITURE DOOR HINGE PROVIDING INCREASED OPENING ANGLE

[75] Inventors: Erich Röck, Höchst; Klaus Brüstle, Lauterach, both of Austria

[73] Assignee: Julius Blum Gesellschaft m.b.H., Höchst, Austria

[21] Appl. No.: 724,285

[22] Filed: Apr. 17, 1985

[30] Foreign Application Priority Data

May 7, 1984 [AT] Austria ..... 1497/84

[51] Int. Cl.[4] ..... E05D 3/06

[52] U.S. Cl. ..... 16/302; 16/370

[58] Field of Search ..... 16/238, 245, 246, 282, 16/288, 291, 293, 294, 295, 296, 302, 303, 370, 382

[56] References Cited

U.S. PATENT DOCUMENTS

| | | | |
|---|---|---|---|
| 3,940,828 | 3/1976 | Lautenschlager | 16/288 |
| 4,112,543 | 9/1978 | Rock et al. . | |
| 4,499,631 | 2/1985 | Laubenschlager | 16/370 |

FOREIGN PATENT DOCUMENTS

| | | | |
|---|---|---|---|
| 353138 | 6/1976 | Austria . | |
| 2408057 | 8/1975 | Fed. Rep. of Germany | 16/294 |
| 2117828 | 11/1980 | Fed. Rep. of Germany | 16/302 |
| 3019511 | 11/1981 | Fed. Rep. of Germany | 16/302 |
| 1128598 | 9/1968 | United Kingdom | 16/370 |

*Primary Examiner*—Fred Silverberg

*Attorney, Agent, or Firm*—Wenderoth, Lind & Ponack

[57] ABSTRACT

A hinge for a door of an article of furniture includes a hinge arm connected with a hinge casing by two hinge links. A closing mechanism includes a leg spring and a pressure member which is pivotally mounted at the hinge arm on an axle of the outer of the two hinge links and presses on a cam member which is mounted on the inner of the two hinge links. The leg spring has legs opposed to the pressure member.

1 Claim, 2 Drawing Figures

SPRING-BIASED FURNITURE DOOR HINGE PROVIDING INCREASED OPENING ANGLE

FIELD AND BACKGROUND OF THE INVENTION

The invention relates to a hinge, in particular for a door of an article of furniture, comprising a hinge arm which is connected with a hinge casing by means of hinge links forming a hinge quadrangle or quadrilateral hinge link mechnanism, the inner hinge link having a cam member provided with a guide curve, a leg spring member urged toward the cam with a pressure member arranged between the spring and the cam member, the pressure member being designed as a guide lever and pivotally mounted at a hinge link axle of the outer hinge arm.

Hinges in which the hinge axles and hinge links are arranged in the above-mentioned manner are increasingly used for modern furniture doors, in particular in arrangements wherein one hinge part has the shape of a casing insertable into a recess of the furniture door, and the other hinge part is designed as a hinge arm having a U-shaped profile and preferably adjustably mountable at a furniture side wall.

By providing such hinges with a spring closing mechanism, a closing pressure is exerted on the door when the hinge is in the closed position. It is thus guaranteed that the door is duly closed and neither remains open at a small angle nor opens by itself if the surface on which the piece of furniture stands is not absolutely plane. Moreover, if a closing mechanism of this kind is provided, an additional holding member for the door, for example a magnetic catch member, is not necessary.

DESCRIPTION OF PRIOR ART

A hinge of this kind is known from AT-PS No. 353 138 corresponding to U.S. Pat. No. 4,112,543. The arrangement of the closing mechanism disclosed therein has the advantage that the space in the hinge arm which is required for the holding and adjusting screws is not occupied by the closing mechanism.

A disadvantage of such hinge is that only opening angles of 90° are possible.

SUMMARY OF THE INVENTION

It is the object of this invention to improve a hinge of this kind such that opening angles of up to 125° and satisfactory closing effects are possible at the same time.

According to the invention this is achieved in that the spring leg is opposed to the pressure member so that the pressure member and the leg of the leg spring acting on the pressure member define two intersecting circular arcs.

A preferred embodiment provides that the pressure member is rolled around one hinge link axle and is provided with a slot in such rolled portion, the inner hinge link extending into such slot when the hinge is in the open position. Thus, the opening angle which is already greater than with conventional hinges can be further increased.

BRIEF DESCRIPTION OF THE DRAWINGS

Below an embodiment of the invention will be described in more detail with reference to the accompanying drawings, in which.

DESCRIPTION OF THE PREFERRED EMBODIMENT

Figure 1:
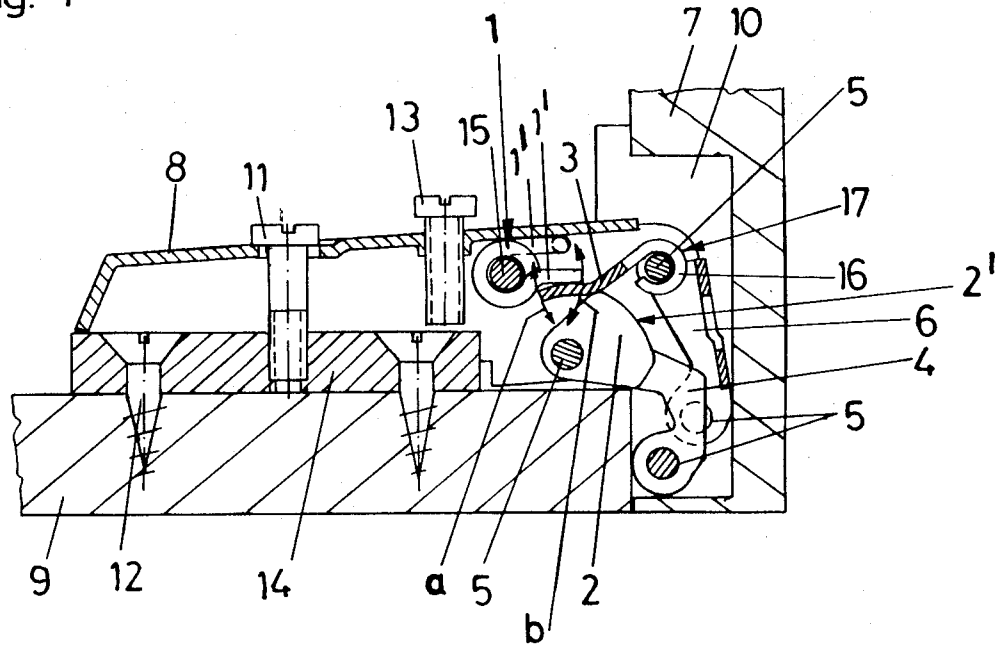
FIG. 1 is a sectional view of a hinge in accordance with the invention in the closed position.

The hinge in accordance with the invention comprises in a conventional manner a hinge arm 8 which is held on a base plate 14 by means of a clamping screw 11. The base plate 14 is fastened to a furniture side wall 9 by means of screws 12.

A hinge casing 10 is inserted into a door 7 and is connected with the hinge arm 8 by means of an inner hinge link 4 and an outer hinge link 6. The hinge links 4,6 are mounted on hinge link axles 5 on the hinge arm 8 and in the hinge casing 10.

An adjusting screw 13 for the adjustment of the joint of the hinge is mounted in a female thread of the hinge arm 8.

The inner hinge link 4 is provided with a cam member 2 which is arranged at the axle 5 connecting the inner hinge link 4 with the hinge arm 8. In the illustrated embodiment, the cam member 2 is a separate part, prferably of plastics material. The cam member 2 has a pressure surface 2'. A pressure member 3, which is designed as a guide lever, is mounted on the hinge link axle 5 connecting the outer hinge link 6 with the hinge arm 8. Pressure member 3 is pressed against the cam member 2 by a leg spring 1.

The leg spring 1 is mounted on a bolt 15 of the hinge arm 8 at a position opposed to the pressure member 3, such that legs 1' of the leg spring 1 are rolled around the bolt 15 and extend toward the pressure member 3.

As can be seen from the drawings, one leg 1' of the leg spring 1 presses on the pressure member 3, and the other leg 1' rests against a center connecting flange of the hinge arm 8 which has a U-shaped profile.

Figure 2:
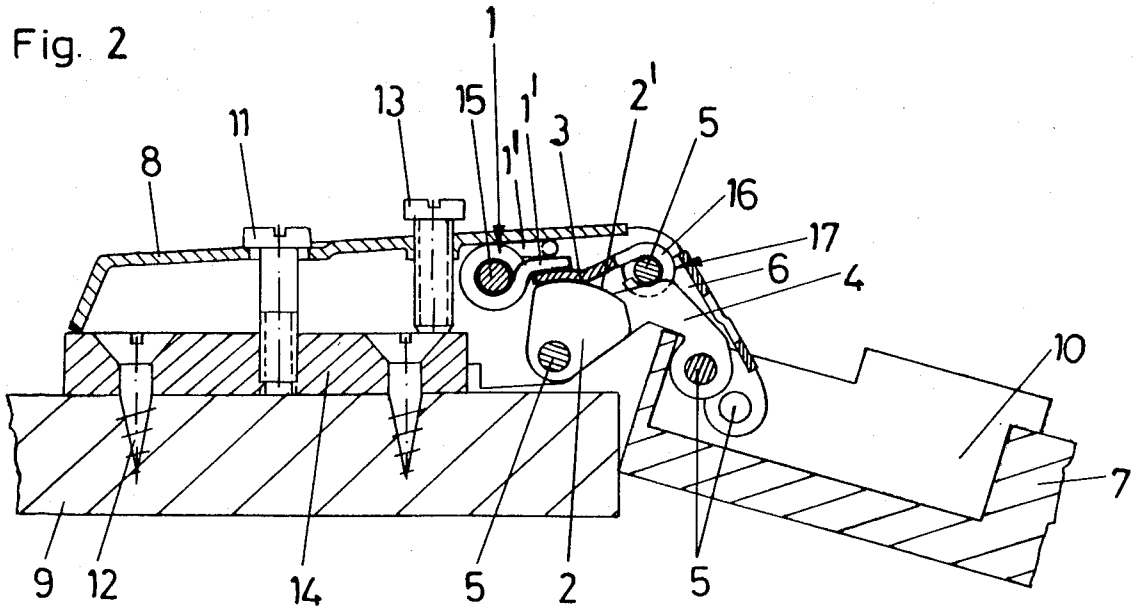
FIG. 2 is a sectional view of the hinge in accordance with the invention in the open position.

In the region of the hinge link axle 5 on which the pressure member 3 is mounted, pressure member 3 is provided with a slot 16 into which the inner hinge link 4 extends when the hinge is in the open position (FIG. 2). Inner hinge link 4 can be guided directly to the hinge link axle 5 through slot 16 in a rolled portion 17 of pressure member 3 surrounding the hinge axle 5, which allows a further increase of the opening angle of the hinge.

What is claimed is:

1. A hinge for mounting a door on an article of furniture, said hinge comprising:

a hinge arm to be mounted on a furniture side wall;

a hinge casing to be mounted on a furniture door;

inner and outer hinge links pivotally mounted to said hinge arm and to said hinge casing by respective hinge link axles, thereby defining a quadrilateral hinge link mechanism connecting said hinge casing to said hinge arm;

a cam member on said inner hinge link at a first said hinge link axle connecting said inner hinge link to said hinge arm, said cam member having a guide surface;

a pressure member having a first end pivotally mounted about a second said hinge link axle connecting said outer hinge link to said hinge arm and a second end;

a leg spring rolled about a bolt mounted on said hinge arm, said leg spring having a leg urging said second end of said pressure member toward said guide surface of said cam member and pivoting said pressure member about said second hinge link axle connecting said outer hinge link to said hinge arm;

said bolt being located at a position opposed to said pressure member such that said leg of said leg spring moves about said bolt in a first circular arc and said second end of said pressure member moves about said second hinge link axle in a second circular arc intersecting said first circular arc;

said first end of said pressure member including a portion rolled around said second hinge link axle, said rolled portion having therethrough a slot, and said inner hinge link extending into said slot when said hinge is in an open position thereof, thereby increasing the opening angle of said hinge.

* * * * *